US006506100B2

(12) United States Patent
Blättler

(10) Patent No.: US 6,506,100 B2
(45) Date of Patent: Jan. 14, 2003

(54) GRINDING TOOL, PROCESSING MACHINE WITH A GRINDING TOOL, USE OF A GRINDING TOOL AND METHOD FOR PROCESSING A WORK PIECE

(76) Inventor: Werner Blättler, Weidstrasse 25c, 6300 Zug (CH)

( * ) Notice: Subject to any disclaimer, the term of this patent is extended or adjusted under 35 U.S.C. 154(b) by 0 days.

(21) Appl. No.: 09/770,900

(22) Filed: Jan. 26, 2001

(65) Prior Publication Data

US 2001/0018316 A1 Aug. 30, 2001

(30) Foreign Application Priority Data

Jan. 28, 2000 (CH) ..... 2000 0165/00

(51) Int. Cl.[7] ..... B24B 1/00
(52) U.S. Cl. ..... 451/44; 451/535
(58) Field of Search ..... 451/44, 489, 490, 451/492, 496, 495, 497, 508, 512, 514, 535, 65, 66, 67, 466

(56) References Cited

U.S. PATENT DOCUMENTS

| | | | |
|---|---|---|---|
| 1,417,593 | A | 5/1922 | Christine |
| 1,654,275 | A | 12/1927 | Strand |
| 2,083,749 | A | 6/1937 | Sword |
| 2,699,632 | A | 1/1955 | Lyon |
| 4,302,911 | A | 12/1981 | Leistner |
| 4,625,466 | A | 12/1986 | Saigusa |
| 4,718,204 | A | 1/1988 | Eisenblätter |
| 5,846,123 | A | 12/1998 | Brown et al. |

FOREIGN PATENT DOCUMENTS

| | | | |
|---|---|---|---|
| CA | 1069801 | | 1/1980 |
| DE | 2411 749 | A1 | 9/1975 |
| DE | 3717 204 | A1 | 12/1988 |
| EP | 0 447 604 | A1 | 9/1991 |
| EP | 0 922 535 | A1 | 6/1999 |
| GB | 806 282 | A | 12/1958 |
| GB | 1 370 846 | A | 10/1974 |
| JP | 5818 1576 | A | 10/1983 |
| JP | 5902 4966 | A | 2/1984 |

*Primary Examiner*—George Nguyen
*Assistant Examiner*—Dung Van Nguyen
(74) *Attorney, Agent, or Firm*—Cummings & Lockwood LLC

(57) ABSTRACT

The invention relates to an axially-functioning grinding tool (10) for fastening on a rotary shaft (14), wherein the tool (10) comprises an inner rotating area (11) and an outer rotating area (12). The inner rotating area (11) supports a cylinder-shaped grinding device with several layers of a grinding device support, which are arranged concentrically around the longitudinal axis of the rotating shaft (14). The outer rotating area (12) is provided with radially arranged strip-shaped grinding devices.

23 Claims, 13 Drawing Sheets

GRINDING TOOL, PROCESSING MACHINE WITH A GRINDING TOOL, USE OF A GRINDING TOOL AND METHOD FOR PROCESSING A WORK PIECE

FIELD OF THE INVENTION

The invention relates to an axially-functioning grinding tool for fastening to a rotating shaft. The invention further relates to a material-processing machine, having a drive motor and a rotating shaft. The invention still further relates to the use of an axially-functioning grinding tool, and finally the invention relates to a method for processing a workpiece.

BACKGROUND OF THE INVENTION

Grinding is a common process employed for treating the surface of a great variety of materials.

A distinction is basically made between three types of grinding processes, namely rotary grinding, oscillatory grinding and linear grinding. Certain combinations of the above mentioned three basic techniques also exist.

A grinding face, which performs a two-dimensional lateral grinding movement (oscillating movement) is often employed in oscillatory grinding. For example, an oscillatory grinder has a grinding face with a grinding device and oscillates in a straight and a circular manner.

Linear grinding is distinguished by a one-dimensional linear movement of the grinding device. A typical example is a so-called belt-grinder with rollers, which pull an endless grinding belt (for example a cloth grinding belt) over a stationary plate. The belt grinder exclusively grinds in one direction and is better suited for large surfaces than an oscillatory grinder.

In rotary grinding there is a rotary grinding body turning around at least one axis. Rotary grinding bodies, wherein a grinding device support of fleece or a fabric with elastic properties are used, are known. Such rotary grinding bodies are used in the treatment of wood (solid and veneer wood), for example, for surface treatments, such as finishing varnish grinding, or intermediate varnish grinding, as well as for smoothing, polishing and deburring of other materials.

For example, barrel-shaped grinding bodies of different diameters and length are used, wherein the grinding body, mounted on a support shaft, rotates. Such a barrel-shaped grinding body grinds in a radial direction with a linearly-extending engagement and abrasion effect. Because of low travel speeds, this attachment is of little interest for the industrial processing of materials. But more complex systems are employed in industry, some of which, however, are very elaborate, because they require several grinding rollers, which are partially obliquely placed and/or oscillate.

The commercially available grinding bodies mostly consist of ready-made abrasives embedded in plastic, textiles, wood or steel. The extensive and expensive storage of different sizes, hardnesses, types of action and abrasive grain sizes in respect to each other is disadvantageous to the user. The one-way use of these tools results in an unnecessary, in part considerable, increased consumption of support materials, along with a corresponding removal expense and the environmental strain and expenses connected therewith.

U.S. Pat. No. 4,625,466 describes a polishing tool with a belt-shaped polishing fabric, whose outer circumference is provided with abrasive grain. This belt-shaped polishing fabric is wound in a spiral shape on a tool disk. The polishing fabric is glued to this tool disk.

U.S. Pat. No. 1,417,593 discloses a further polishing tool. In this case a polishing device is spirally wound on it and fastened on a rotating disk by means of a clamping ring.

Another grinding tool is known from published European Patent Application EP 0 922 535 A1. The grinding tool is provided with radially arranged grinding plates. Radially arranged intermediate elastic elements are located between these grinding plates.

A further grinding tool can be found in German Letters Patent DE 24 11 749. With this tool, abrasive-coated paper in several bundles is arranged on the circumference of a rotating grinding disk. These bundles point radially outward. The service life of this tool can be extended by means of the bundling of several layers of abrasive-coated paper.

OBJECT AND SUMMARY OF THE INVENTION

The object of the invention is based on producing tools and tool holders for processing workpieces.

It is a further object of the present invention to produce tools and tool holders which in particular make possible their being equipped in different ways in order to make possible the matching to the materials, surface shapes and surface conditions to be worked.

It is a still further object of the present invention to produce tools and tool holders which can be employed in connection with performance-oriented continuous production installations.

It is a yet further object of the present invention to produce tools and tool holders which, by means of the specific arrangement of a grinding device, perform the optimal cross-grinding effect with simultaneous working of rounded edges for varnish finishing or intermediate varnish finishing on surfaces with or without rounded edge ends, such as strips, profiles, window elements, etc.

The attainment of these objects is achieved in accordance with the invention by means of axially-functioning tools, a processing machine, and the use of the axially-functioning tools for workpiece processing in accordance with a preferred method for processing a workpiece.

The axially-functioning tool is adapted for being fastened to a rotating shaft and includes an inner and an outer rotating area. The inner rotating area includes a cylinder-shaped grinding device having several layers of a grinding device support which are arranged concentrically around the longitudinal axis of the rotating. shaft. The outer rotating area includes radially arranged strip-shaped grinding devices.

The material processing machine includes a drive motor and a rotating shaft operatively associated with the drive motor on which the axially-functioning tool is. attached.

The preferred method for processing the workpiece includes the steps of moving the workpiece in a linear direction and cross-grinding at least one surface of the workpiece by means of a multiple-layered cylindrical-shaped grinding device arranged concentrically around a rotating shaft. The method further includes edge grinding along at least one edge of the workpiece by means of strip-shaped grinding devices arranged in a radial direction in respect to the rotating shaft.

Advantageous further developments of the tools in accordance with the invention, the processing machine in accordance with the invention, the use in accordance with the invention and the method in accordance with the invention are defined in the dependent claims.

It is an advantage of the present invention that by equipping the tool holder in different ways, the tool can be adapted to the materials, surface shapes and surface conditions to be processed, and to the intended type of processing. Because of this, a cost-effective and flexible tool is available, which can be employed for the most varied purposes. It is a further advantage of the invention that commercially available grinding devices can be used for equipping the tool holder. This application can be performed in a simple manner by the user himself.

The tool in accordance with the invention can be used for simultaneous surface grinding, in particular for surface cross grinding (surface grinding with cross-grinding effects), and for grinding adjacent radii.

The tool can moreover be embodied in such a way that in connection with processing of wood it is also suitable as a high-performance tool for fine grinding up to varnish finish.

In other words: the tool in accordance with the invention is universal and offers a plurality of different employment options.

Further properties and advantages of the invention will be described in greater detail in what follows by means of the description and with reference to the drawings.

DETAILED DESCRIPTION

For the sake of simplicity, "grinding" is mainly addressed in what follows, and it should be noted that the term "grinding" in connection with the present document includes polishing, smoothing, reducing, lapping, deburring, dulling, engaging, cleaning of the material and roughening the material.

The grinding tool holder in accordance with the invention can be equipped with different grinding devices. Commercially available grinding devices, or special different grinding devices can be employed wherein, however, basically a flexible grinding device support (for example paper, fleece, felt, cloth or other fabrics, etc.) can be used, which is provided with a grinding device. Abrasive grain or other grinding materials (for example steel wool, hard fibers, etc.) can be used as a grinding device. Among the natural abrasive grains are fluin, garnet, emery and quartz. Artificially produced abrasive grains are aluminum oxide (corundum and special fused alumina), silicon carbide, glass and synthetic diamonds.

The tool holders in accordance with the invention make possible a plurality of differently equipped types, so that the entire tool can be appropriately matched to different materials, types of processing, surface shapes and surface conditions.

Figure 1A:
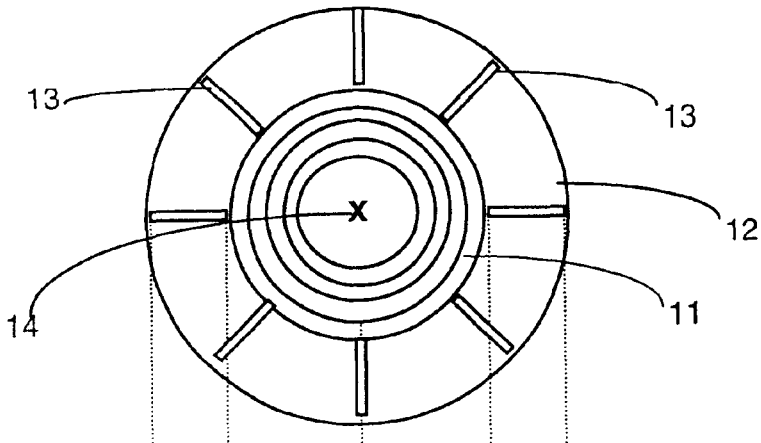
FIG. 1A is a view from below of the tool in accordance with the invention.
Figure 1B:
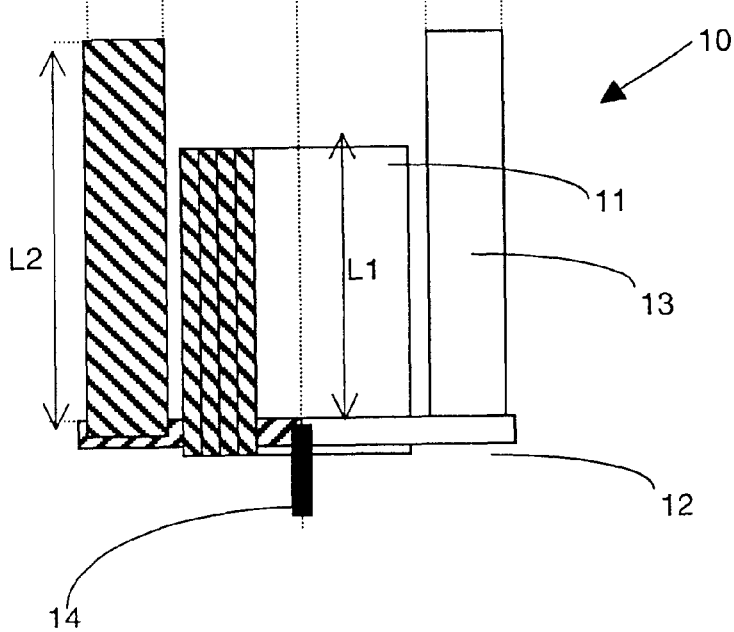
FIG. 1B is a combined sectional/lateral view of the tool in accordance with the invention in FIG. 1A.

This is achieved by means of the modular constructed abrasive device support consisting of two different grinding bodies acting in the axial direction. A simple grinding tool holder 12 which, in accordance with the present invention, is provided with two such grinding bodies, is schematically represented in FIGS. 1A and 1B. As shown in the view from below (FIG. 1A), the tool has an interior rotating area and an exterior rotating area. These areas are concentrically arranged around the axis of rotation 14 of the grinding tool holder 12.

A grinding device 11 is arranged in the interior rotating area of the present embodiment. It consists of four layers of a grinding device support, as can be seen in the sectional view on the left side of FIG. 1B. These four layers form a cylinder-shaped grinding device 11, which is arranged concentrically in respect to the axis of rotation 14 and perpendicularly in respect to the surface of the disk-shaped grinding tool holder 12. The interior area mainly grinds with the front face (see FIG. 7, for example). The softness can be varied by means of slits in the cylinder-shaped grinding device.

A number of tab-shaped grinding devices 13, which point radially away from the axis of rotation toward the exterior, is located in the exterior area of the tool 10. In the present example the tool 10 has eight such tab-shaped grinding devices 13.

Figure 1C:
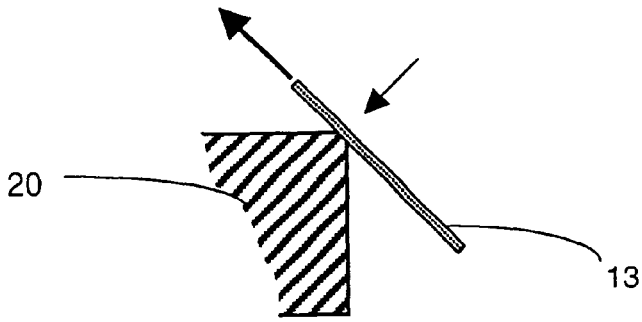
FIG. 1C illustrates a strip-shaped grinding device in contact with a workpiece.

In the represented example, the tab-shaped grinding devices 13 are slightly longer (length L2) than the height L1 of the cylinder-shaped grinding device 11. In other words, the tab-shaped grinding devices 13 project past the cylinder-shaped grinding device 11. With appropriate dimensioning and arrangement (for example as indicated in FIGS. 1A and 1B), these tab-shaped grinding devices provide the grinding of edges. This grinding effect is schematically represented in FIG. 1C. A single grinding tab 13 can be seen in this figure which, in the instantaneous picture shown, grinds along an edge of a workpiece 20. In this example the grinding movement extends from bottom right to top left. The edge of the workpiece 20 is ground by means of this. The more rigidly and less flexibly the grinding tabs 13 are fastened, the greater the contact pressure against the edge of the workpiece 20.

Varied forms of grinding devices are schematically represented in FIGS. 2A to 2C and 3A and 3B. These grinding devices are particularly suited for employment with a grinding tool in accordance with the present invention.

Figure 2A:
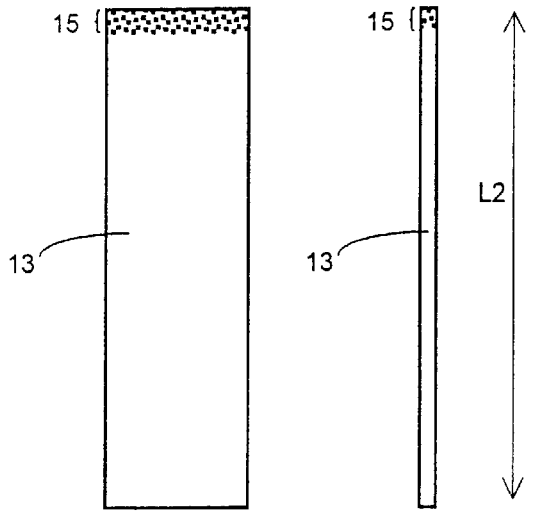
FIG. 2A is a front and a lateral view of a grinding device which can be used for equipping the tool in accordance with the invention, FIG. 15

The tab-shaped grinding device 13 represented in FIG. 2A consists of a flexible grinding device support, which is provided with grinding devices 15 (for example abrasive grains) on the upper edge.

Figure 2B:
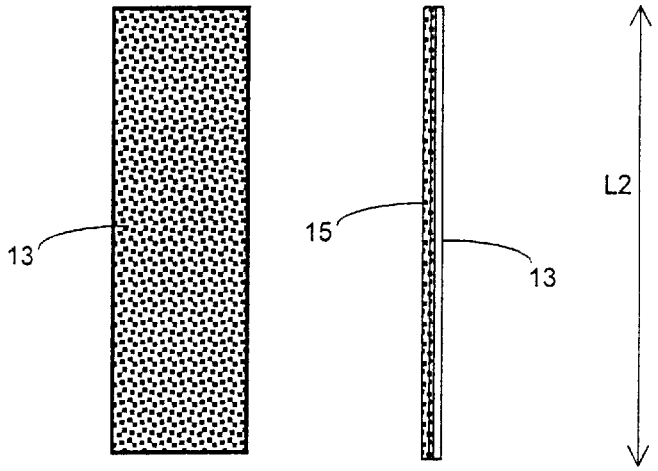
FIG. 2B is a front and a lateral view of a further grinding device which can be used for equipping the tool in accordance with the invention.
Figure 2C:
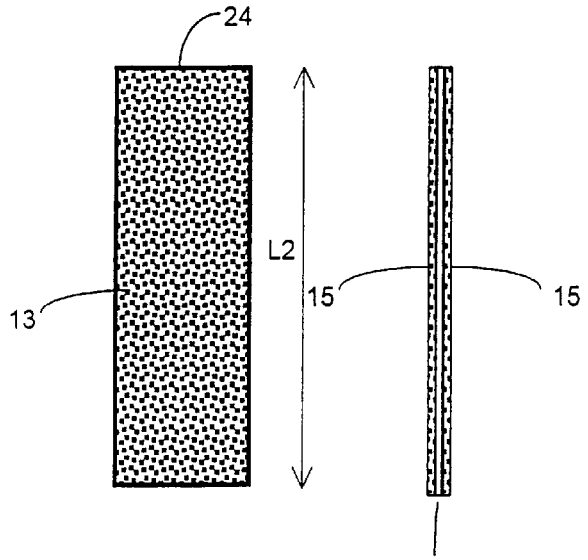
FIG. 2C is a front and a lateral view of a still further grinding device which can be used for equipping the tool in accordance with the invention.

FIG. 2B shows another form of a tab-shaped grinding device 13. In this case the tab-shaped grinding device 13 consists of a flexible grinding device support provided on one side with a grinding device layer 15 (for example abrasive grains).

2C shows a further development of the grinding device represented in FIG. 2B. In the case represented in FIG. 2C, the grinding device 13 includes a flexible grinding device support provided on both sides with a grinding device layer 15 (for example abrasive grains). The tab-shaped grinding device strip 13 can be designed to be softer by providing it with one or several slits 24.

Figure 3A:
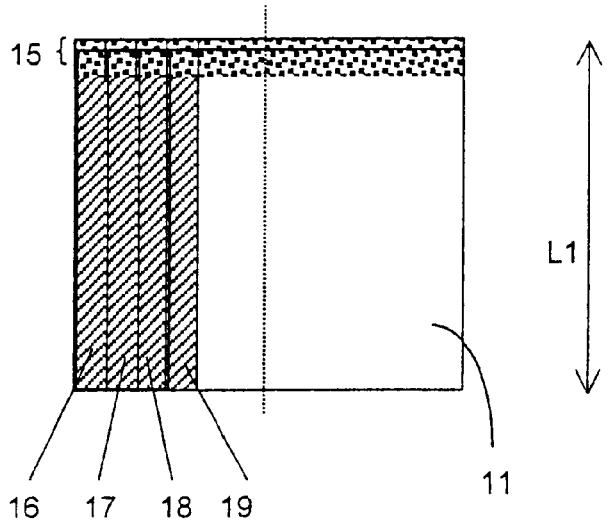
FIG. 3A is a combined front/lateral view of a grinding device which can be used for equipping the tool in accordance with the invention.
Figure 3B:
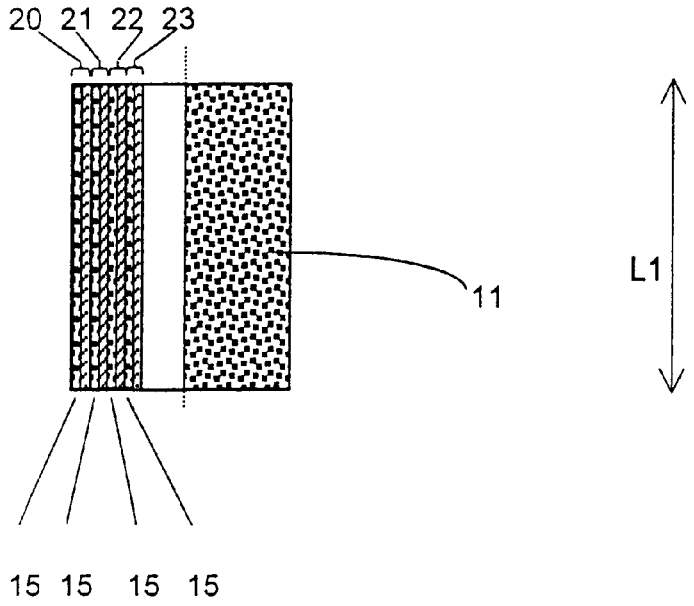
FIG. 3B is a combined front/lateral view of a further grinding device which can be used for equipping the tool in accordance with the invention.

Two different cylinder-shaped grinding devices 11 are represented in FIGS. 3A and 3B. The grinding device 11 in FIG. 3A consists of several concentric layers of grinding device supports 16, 17, 18 and 19 (a total of four layers in the present example). These grinding device supports 16, 17, 18 and 19 are provided on the upper edge with a grinding device 15 (for example abrasive grains).

The grinding device 11 represented in FIG. 3B consists of several concentric layers of grinding device supports 20, 21, 22 and 23 (a total of four layers). Each one of these grinding device supports 20, 21, 22 and 23 is provided on one side with a grinding device layer 15 (for example abrasive grains). In the represented example this grinding device layer 15 points to the outside. The diameter of the grinding device 11 represented in FIG. 3B is less than the one represented in FIG. 3A.

The represented grinding devices are merely examples to show how richly varied the tool in accordance with the invention can be equipped by the use of different grinding devices.

Figure 4A:
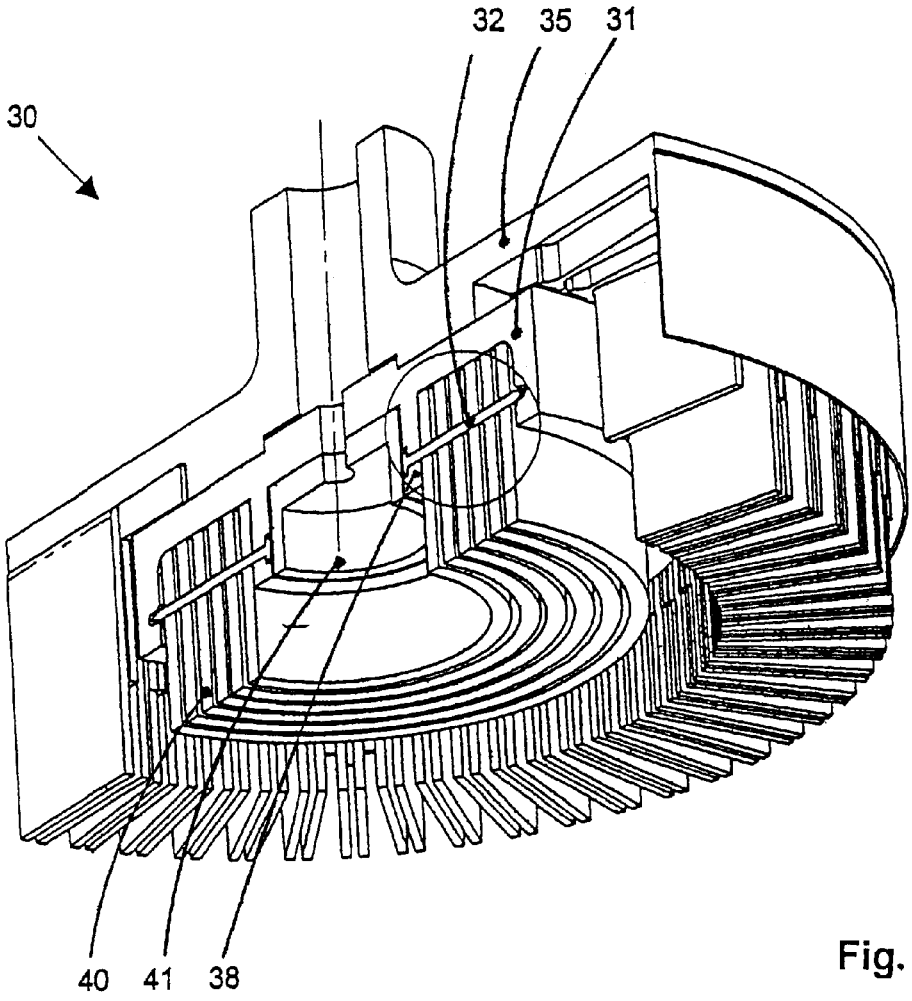
FIG. 4A is a perspective sectional representation of a further tool in accordance with the invention.
Figure 4B:
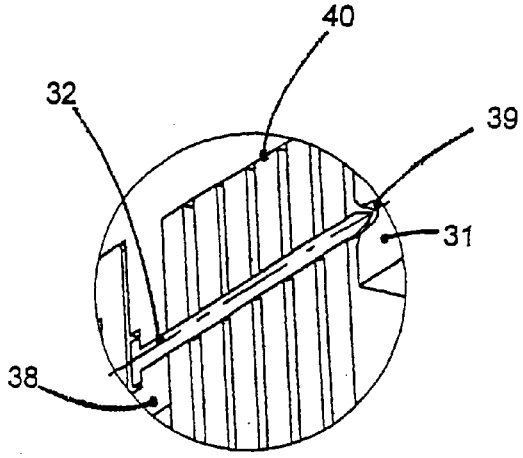
FIG. 4B shows an enlarged detail from FIG. 4A.
Figure 7:
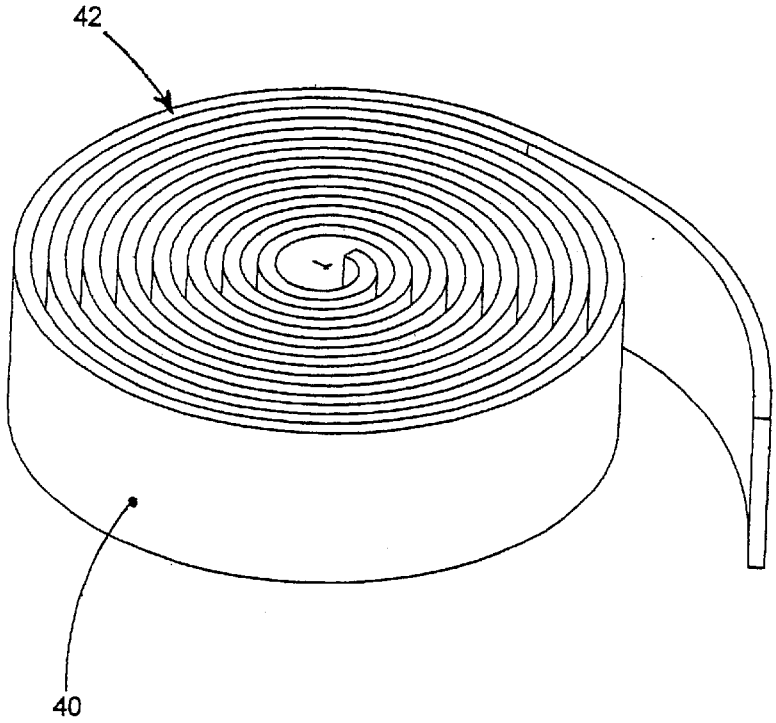
FIG. 7 is a perspective sectional representation of a further tool in accordance with the invention with a grinding device arranged in a fan shape.

A further embodiment of the tool 30. in accordance with the invention will be described in what follows by making reference to FIGS. 4A and 4B. In the embodiment represented, a strip 38 is attached on the inside and a strip 31 on the outside of a rotating body 35 in the axial direction at the distance of the width of the grinding device application. A commercially available grinding fleece strip 40, or a grinding belt strip or other flexible, belt-shaped grinding devices of the desired quality, hardness and abrasive grain size are wound around the inner strip 38 as far as the outer strip 31. A suitable grinding belt strip 40 is represented in FIG. 7. Nails or nail-shaped pins 32, preferably with a head, are pushed radially outward through holes in the inner strip 38 in order to pierce the grinding device 40 and to fix it in place. A groove 39 at the inside of the outer strip 31 is used here as a locking means against an axial excursion, and a filler element 41 in the center prevents the nails 32 from falling out.

If the grinding belt strip 40 is wound under little tension on the inner area, a loose grinding device results, causing a soft grinding effect. The grinding effect becomes greater by winding it tighter.

Figure 5:
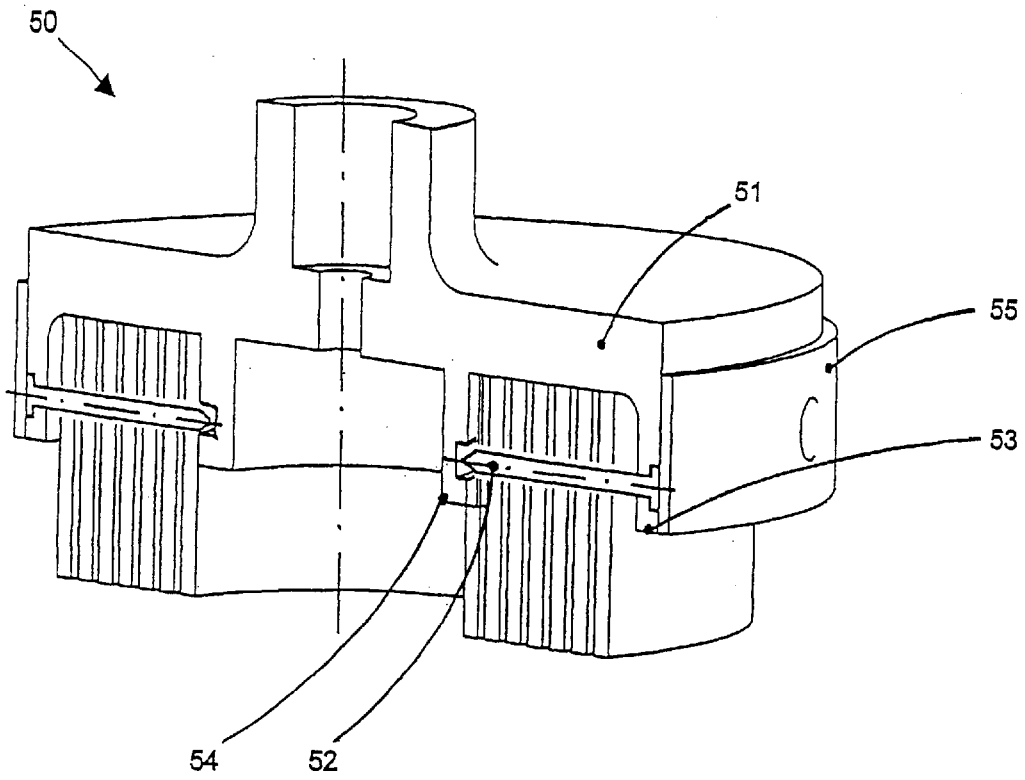
FIG. 5 is a perspective sectional representation of a tool in accordance with the invention with a grinding device arranged in a spiral-like way and pierced from the outside toward the inside and secured with an outer ring.

Another embodiment of the tool 50 in accordance with the invention is represented in FIG. 5. With this embodiment the rotating body 51 is constructed in such a way that pins 52 are pushed radially inward through holes in the outer strip 53 and are inserted into a groove on the outside of the inner strip 54 or into holes. In this case the pins 52 can be secured, for example by a screwed-on inverted ring 55.

Figure 6:
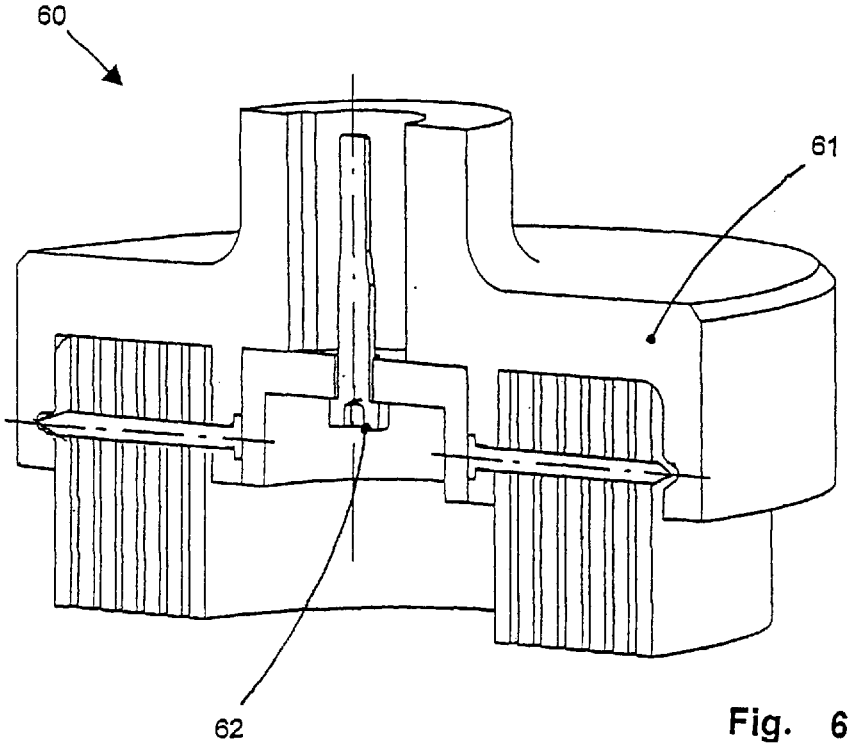
FIG. 6 is a perspective sectional representation of a further tool in accordance with the invention with a grinding device arranged in a spiral-like way and pierced from the inside toward the outside and secured with an inner ring.

A further embodiment of the tool 60 in accordance with the invention is represented in FIG. 6. It can be seen in this figure how the shaft 62 of a drive motor (not represented) is arranged in the center of the rotating body 61. The rotating body 61 is caused to rotate by means of the drive motor.

Figure 8:
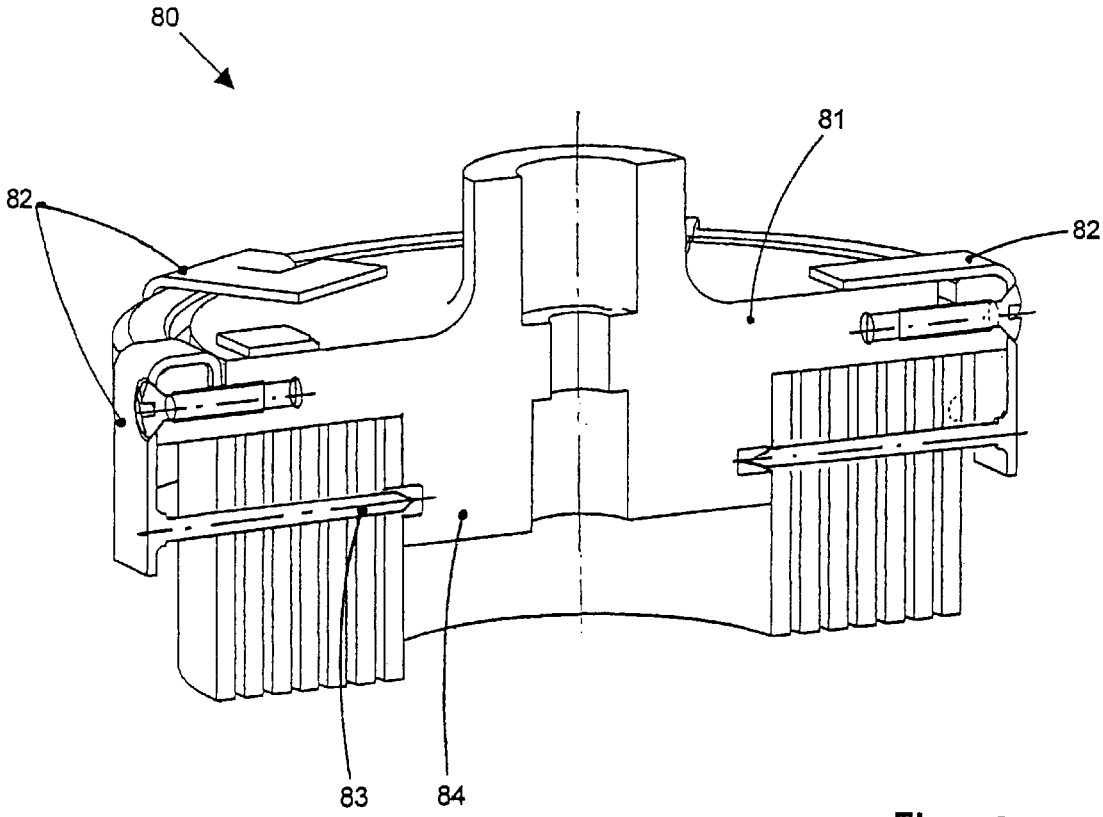
FIG. 8 is a perspective sectional representation of a further tool in accordance with the invention with a grinding device arranged in a spiral-like way and with fixation nails at the claw with a securing tongue.

A further fastening possibility for attaching the grinding device 40 is shown in FIG. 8. The tool 80 represented is equipped with the grinding device 40, which is fastened by means of several clamps. Each of the clamps 82 has a pin 83, which penetrates through the grinding device 40 and preferably engages the inner strip 84 of the tool 80. A screw connection, such as indicated in FIG. 8, can be used for fixing the clamps 82 on the outer rim of the tool 80. It should be noted that in this embodiment the tool 80 does not have an outer strip.

Instead of fixing the clamps 82 in place by means of screw connections, as shown in FIG. 8, a circular securing plate can be fastened from behind on the tool 80. To this end, the securing plate must have a central hole, so that the plate can be pushed from behind over the central neck of the tool 80. In this case the securing plate can be screwed by means of screw connections, for example, from behind against the tool 80. Screw holes can be provided for this in the back of the tool, which extend through the tool 80 from behind as far as the inner strip 84. These screw holes are advantageously aligned parallel with the axis of rotation of the tool 80. The exterior diameter of the securing plate should be selected to be such that the clamps 82 are maintained in their position by means of the securing plate.

Different arrangement and fastening options for a cylinder-shaped grinding device on a disk-shaped rotating body are represented in FIGS. 4A, 4B, 5, 6 and 8. The tools 30, 50, 60 or 80 represented in these figures can be advantageously used for surface grinding with a cross-grinding effect.

Figure 9:
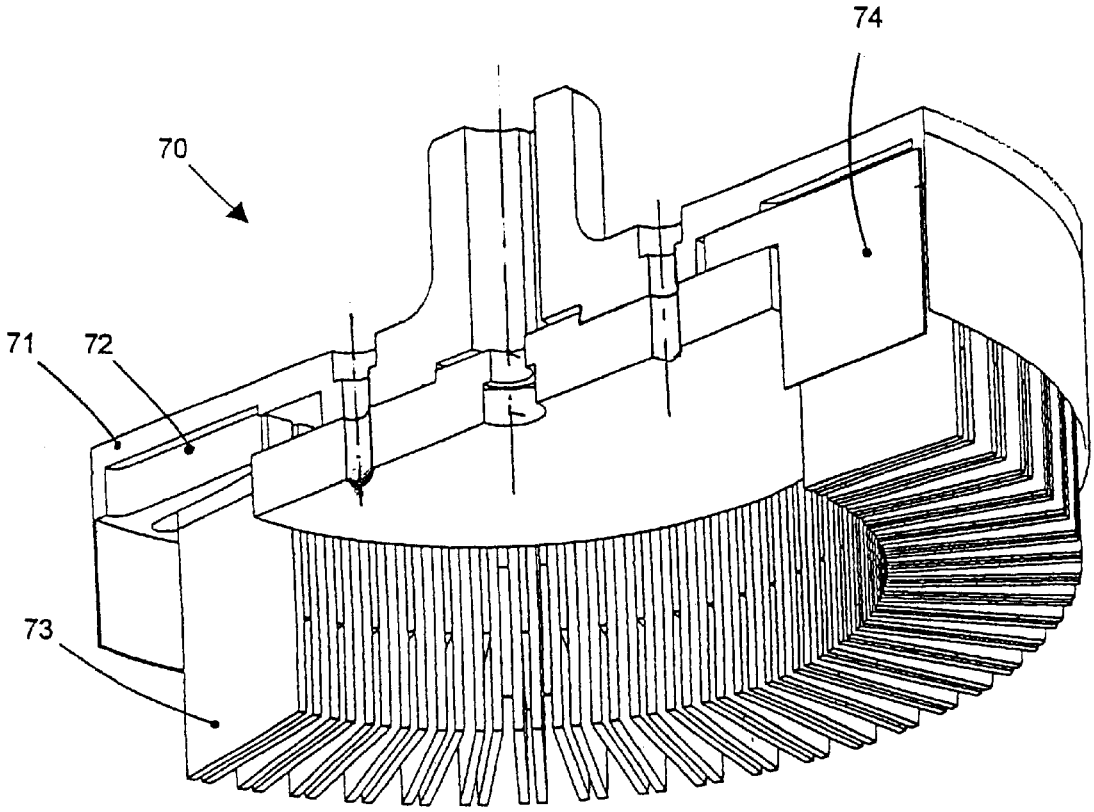
FIG. 9 is a perspective representation of a strip-shaped grinding device, wound spirally, which can be used for equipping the tool in accordance with the invention.

Equipping the tools in accordance with the invention with tab-shaped grinding devices (grinding device strips) will be explained in what follows. A supplemental grinding tool holder 70 (see FIG. 9), also designed as a rotating body 71, is provided for grinding rounded edges. The rotating body 71 has radially oriented depressions 72. As shown in FIG. 9, cut-to-size grinding device strips 73, preferably grinding fleece or a grinding belt, can be inserted in a fan shape into these radially oriented depressions 72. A specially shaped intermediate layer 74 can be used for fastening the grinding device strips 73. This intermediate layer 74 is provided with a finger for causing a holding and support effect. To this end, the intermediate layer 74 is preferably constructed in such a way that the finger can be clamped under a disk or under another tool element (for example a rotating body in accordance with FIGS. 5, 6 or 8). Details of this can be taken from FIG. 10. As indicated, a grinding device strip 73 is centrally fixed in place by means of an intermediate layer 74 in such a way that the grinding device strip 73 has two free ends 75.

Figure 11:
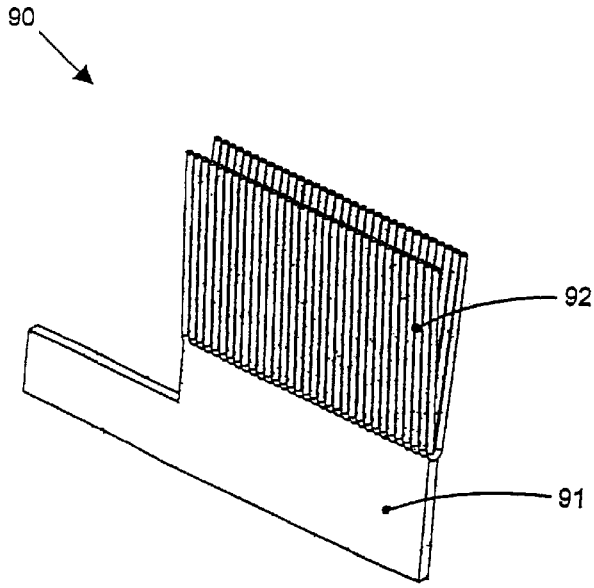
FIG. 11 is a perspective representation of a holder/support plate with bristles, which can be used for equipping the tool in accordance with the invention.

Another form and shape of an intermediate layer 90 can be seen in FIG. 11. It consists of a lower element 91, which is used for clamping, or fastening on the rotating body. A grinding device strip 92 is provided at the upper end of the intermediate layer 90. By means of shaping the intermediate layer differently in respect to thickness, hardness and height it is possible to match the support of the grinding device strips individually to the requirements.

As an alternative, the intermediate layer can be composed of two or more different materials. For example, a finger made of metal or plastic as the support and a bristle strip as the support body.

Figure 10:
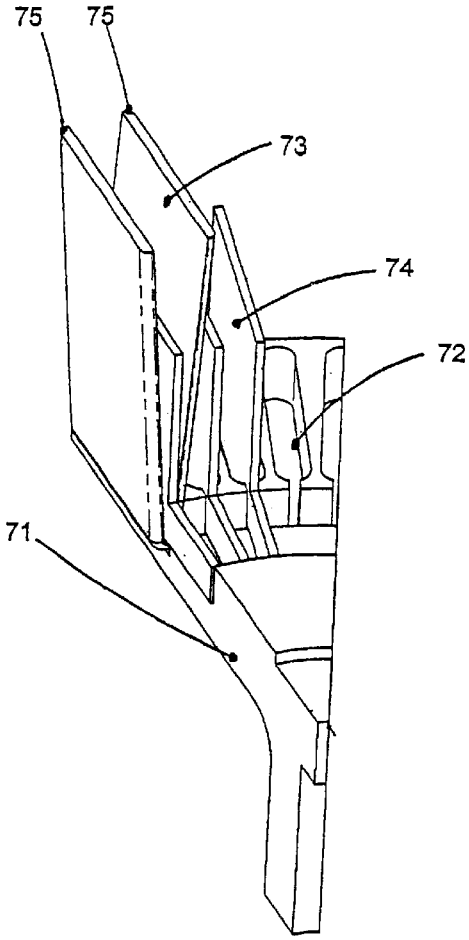
FIG. 10 is an enlargement of a section of a strip-shaped grinding device, which has been cut to size and folded, inserted in a fan shape into grooves and has a support plate, and which can be used for equipping the tool in accordance with the invention.
Figure 12:
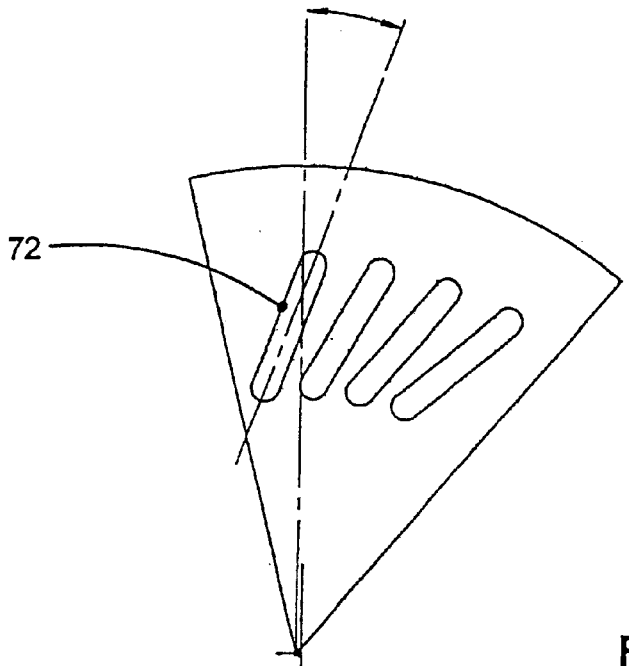
FIG. 12 is a view from below of a section of a further tool in accordance with the invention with radially extending depressions at a positive angle.
Figure 13:
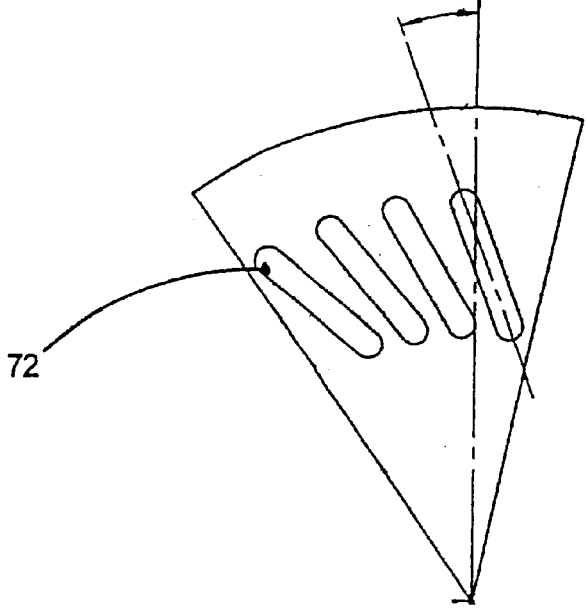
FIG. 13 is a view from below of a section of a further tool in accordance with the invention with radially extending depressions at a negative angle.

The depressions in the rotating body for receiving the intermediate layers can be arranged either axially (for example as indicated in FIG. 10), or with a positive angle axially (see FIG. 12) or a negative angle (see FIG. 13) in respect to the axial position.

Figure 14:
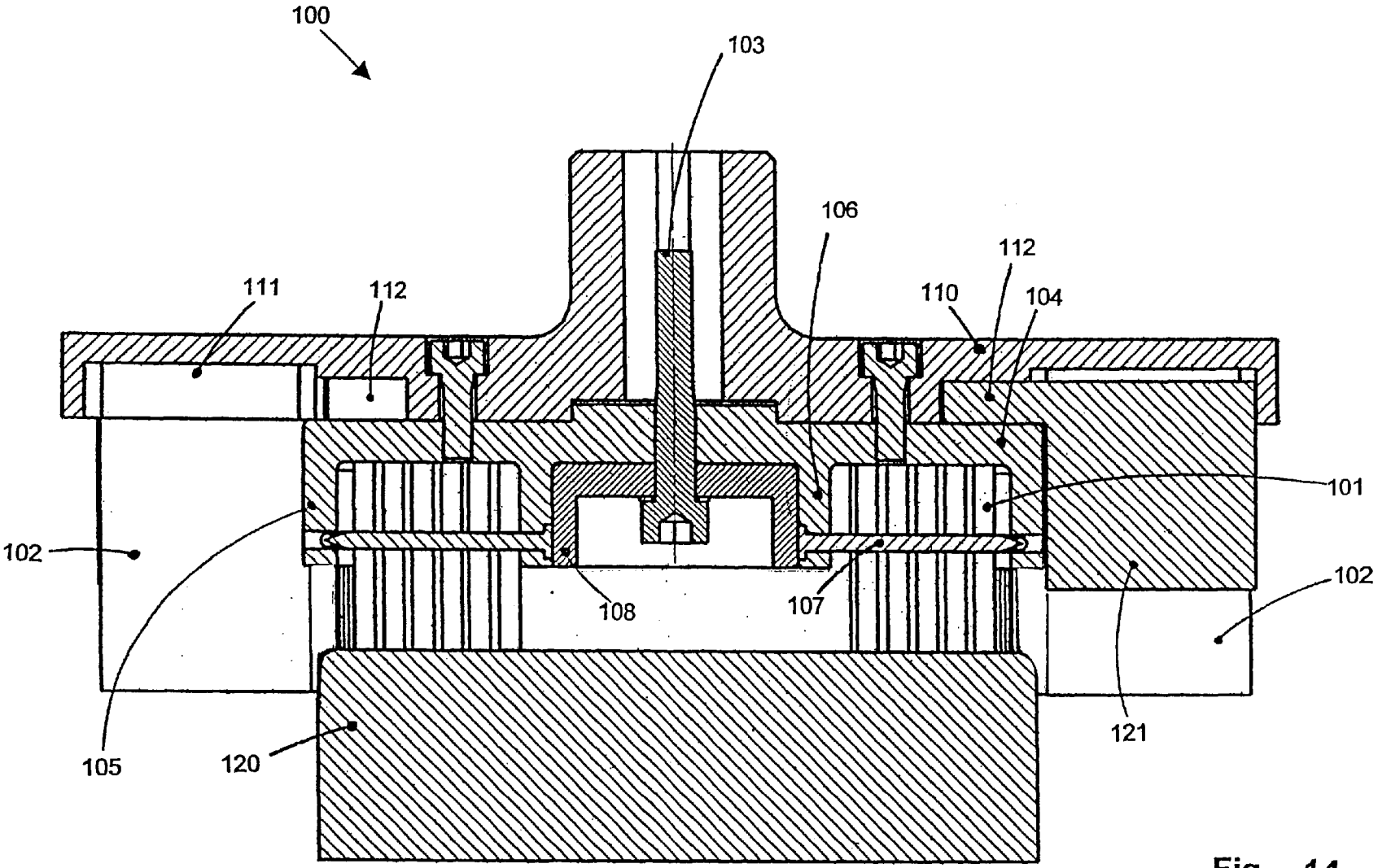
FIG. 14 is a sectional view of a further tool in accordance with the invention with a spiral-shaped and fan-shaped grinding device and with a tool profile.

FIG. 14 shows a section through a tool 100, which is equipped with a cylinder-shaped grinding device 101 and with several strip-shaped grinding device strips 102. The tool 100 is seated on a shaft 103. The inner rotating body 104 has an inner strip 106 and an outer strip 105. The cylinder-shaped grinding device 101 is fixed in place by pins 107 and a filler element 108. The outer rotating body 110 has axial depressions 111. The sectional view shows that an intermediate layer 121 is seated in such a depression 111. The finger 112 of the intermediate layer 121 is clamped against falling out by means of the inner rotating body 104. The intermediate layer carries a grinding device strip 102. The sectional view shows that the tool 100 momentarily processes a workpiece 120. To this end the tool 100 rotates around the axis 103. Simultaneously, the workpiece 120 is either conducted in a linear movement past the tool 100, or the tool is conducted along the workpiece 120.

It is possible by means of the axially-functioning grinding tool in accordance with the present invention to produce particularly efficient and high-quality material processing machines. A drive motor with a rotating shaft (drive shaft), which drives the axially-functioning grinding tool, can be provided for this purpose. In a further embodiment, the machine can be provided with a drive means which conducts a workpiece in a linear movement past the grinding tool. It is possible to use a conveyor belt with drive rollers, for example, for this.

Such a material processing machine can be equipped with a drive means, by means of which the grinding tool performs an eccentric movement in respect to the workpiece to be processed.

The axially-functioning grinding tool can be ideally used for performing the processing of wood in accordance with a continuous method. The axially-functioning grinding tool is particularly well suited for processing individual pieces of wood (for example squared timber, window frames or the like) in a continuous process.

The grinding tool holder in accordance with the present invention customarily is made of plastic, aluminum or steel, and can preferably be operated by means of a standard motor via a flange with a receiving bore and a key track. The grinding tool holder is fastened on the motor shaft for this purpose. This motor shaft, or the motor, can be seated spring-supported (for example pneumatically spring-supported).

A rapid change system can be employed for a flexible material processing installation (for example a high-performance production installation).

The tool in accordance with the present invention is typically operated in a speed range between 200 and 5000 rpm. A speed between 500 and 1500 rpm is particularly suitable. The speed should be matched to the material to be ground and the actual equipment of the tool.

Figure 15:
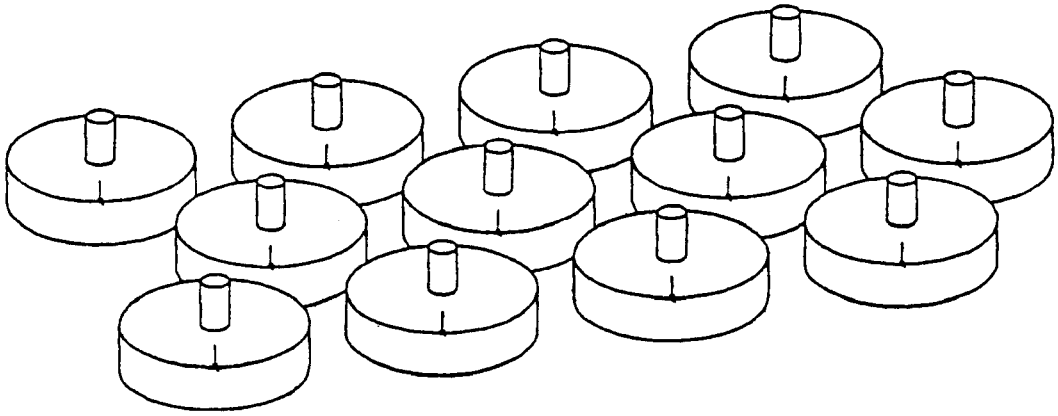
FIG. 15 is a schematic representation of a multiple arrangement of tools in accordance with the invention over the width and length of travel.

The rotating axially-functioning grinding tool holder can be arranged individually (as represented in FIG. 14) or multiply, for parts with large surfaces, over the width and length of travel. An arrangement of several tools in accordance with the invention is shown by way of example in FIG. 15. A total of twelve axially-functioning grinding tools has been arranged, offset in relation to each other, in the example shown. In this case it can make sense to employ tools of different degrees of fineness over the length of travel.

Fastening at the support can be fixed or, for optimizing the grinding pressure, spring-loaded or pressure-controlled. A continuously rpm-controlled, directly applied standard motor should preferably be employed as the drive mechanism. In case of a multiple arrangement as in FIG. 15, the tool holders are customarily driven via belts or toothed belts.

Figure 16:
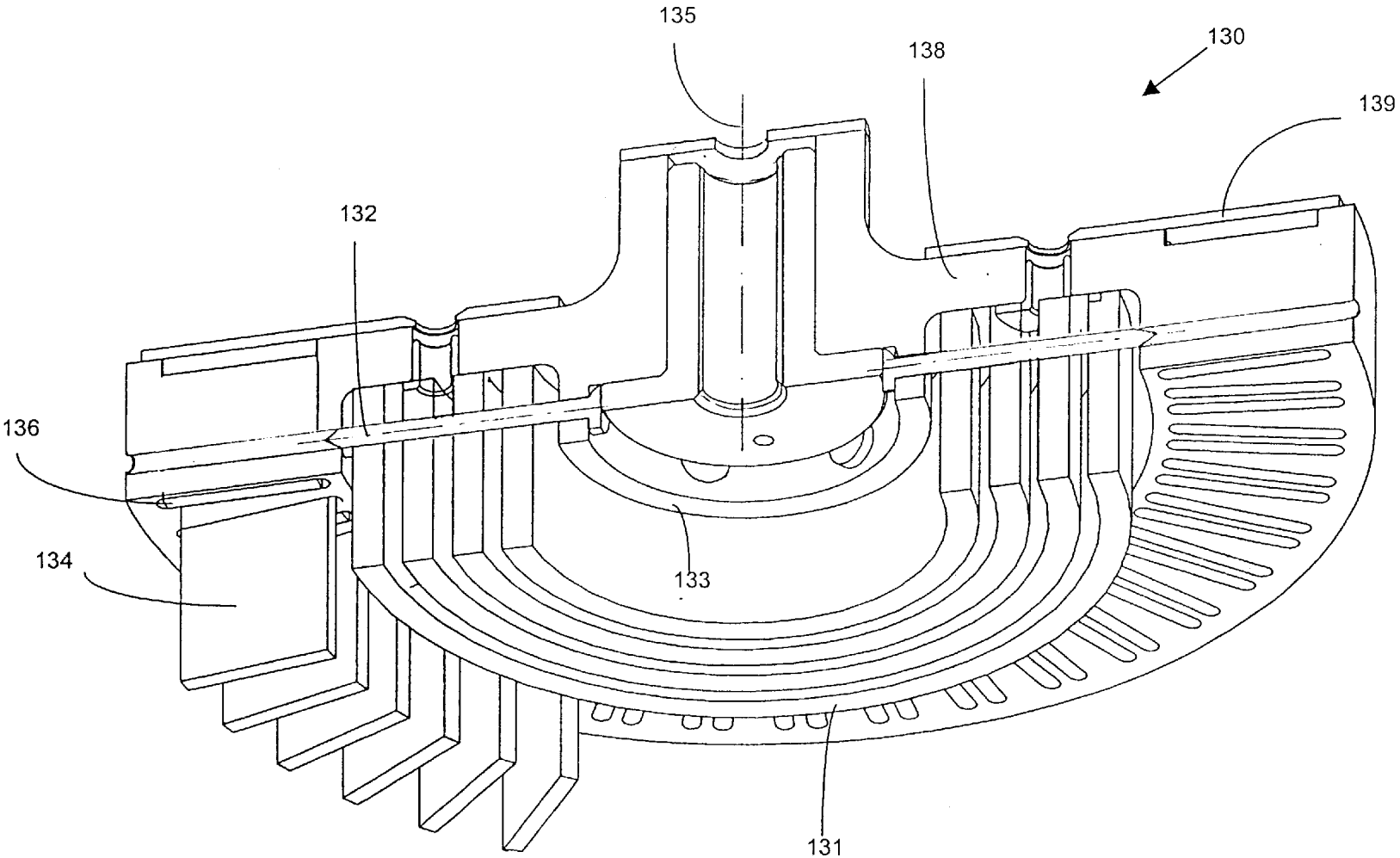
FIG. 16 is a perspective sectional representation of a further tool in accordance with the invention with a grinding device arranged in a spiral-like way and with grinding device strips.
Figure 17:
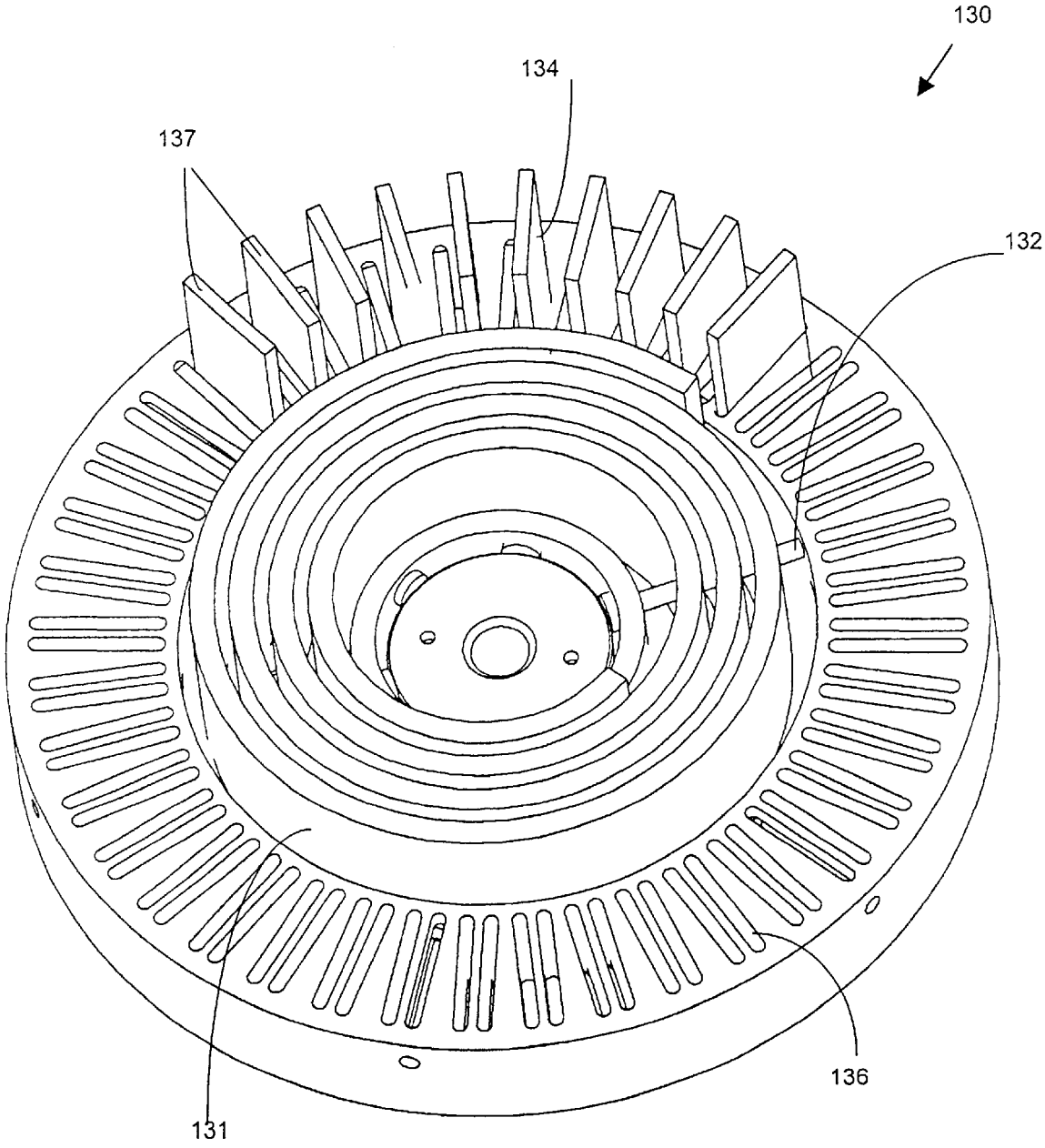
FIG. 17 is a view from below of the tool of FIG. 16.

A further embodiment of a tool 130 in accordance with the invention is represented in FIGS. 16 and 17. It can be seen in these figures, that the tool 130 carries a grinding fleece strip 131, or a grinding belt strip or other flexible, belt-shaped grinding devices of the desired quality, hardness and abrasive grain size. This strip 131 is fixed by several fixation nails 132 or nail-shaped pins. The fixation nails 132 are pushed radially outward through holes in an inner wall 133 of the body 138 in order to pierce the strip 131 and to fix it in place.

The tool 130 further comprises a number of grinding device strips 134, which point radially away from the axis of rotation 135 toward the exterior. These grinding device strips 134 are located in the exterior area of the tool 130. In the present example, the tool 130 comprises radially oriented holes 136 which are designed such that the grinding device strips 134 can be inserted from the back side (top side) of the tool 130. When equipping the tool 130, the two ends of a grinding device strip 134 are inserted from the back side (top side) of the tool 130 into two adjacent holes 136 such that their free ends 137 point towards the work piece which is to be treated. The tool 130 depicted in FIG. 17 is equipped with 5 grinding device strips 134. The grinding device strips 134 are fixed by applying a disk 139 to the back side of the body 138. This disk 139 can for example be fixed by means of screws.

It is an advantage of the tool 130 that the body 138 can be made from one piece. Well suited are metals, plastic, or the like.

The following steps are performed in a method in accordance with the invention for processing a workpiece with at least one surface and one edge. The workpiece is caused to perform a linear movement along the axially-functioning tool. This tool is put into rotation, wherein the inner and the outer rotating bodies rotate around an axis which coincides with the longitudinal axis of the drive mechanism. In the course of this, cross-grinding of the surface of the workpiece and edge grinding along the edge of the workpiece take place simultaneously.

This method can be further improved in that a belt-grinding step is first performed for preparing the workpiece. Ideally, a radial grinding step follows the cross grinding and edge grinding.

These steps offer an excellent basis for a subsequent application of water lacquer, for example as a water lacquer base. With this method the otherwise customary intermediate lacquer grinding can be omitted.

Besides the large selection of commercially available grinding devices in respect to granulations, support materials, etc., there are several possibilities of varying the effects of the grinding fleece or grinding belt strip, which is made of one piece and circulates at the same level. An intermediate layer strip of individually matched thickness, hardness and height is preferably wound up parallel for matching the grinding effects to the requirements.

The inner area of the tool in accordance with the invention typically has a diameter between 100 mm and 2000 mm. The outer area can have a diameter between 200 mm and 2500 mm.

The tools in accordance with the present invention are suitable for wet and dry grinding. A suitable electronic control permits grinding to fit the material.

It is possible to employ an eccentric movement in addition to the rotatory movement of the tools in accordance with the invention in order to obtain even finer grinding along, with a high removal output because of the doubled grinding movement.

One type of effect of the described tools is surface grinding with a cross-grinding effect, for example for the removal of hairs on wood materials with previously linearly ground surfaces. The cross-grinding effect occurs when there is a relative forward movement between the material to be ground and the tool. Another type of effect is grinding of rounded edges (see the workpiece 120 in FIG. 14) on strips, profiles, window elements, table tops, doors, etc.

The tool in accordance with the present invention can either be constructed as previously described in such a way that it can be newly equipped, or prefabricated tool holders can be used, which are disposed off after use. For example, the inner area and/or the outer area can consist of tool holders which are permanently equipped with the required grinding device(s). The inner area can be solidly embedded in plastic, for example. In this case the grinding device cannot be exchanged.

What is claimed is:

1. An axially-functioning grinding tool for being fastened to a rotating shaft, comprising: a grinding tool having an inner and an outer rotating area, wherein:

a) the inner rotating area has a cylinder-shaped grinding device having several layers of a grinding device support, which are arranged concentrically around a longitudinal axis of the rotating shaft, and b) the outer rotating area has radially arranged strip-shaped grinding devices.

2. The grinding tool in accordance with claim 1, wherein the layers of the cylinder-shaped grinding device comprise at least one of several individual cylinder-shaped grinding device layers which are concentrically positioned within each other, or are formed by spirally wound grinding device strips.

3. The grinding tool in accordance with claim 1, wherein the grinding tool further comprises a disk-shaped grinding tool holder.

4. The grinding tool in accordance with claim 1, wherein the strip-shaped grinding devices project past the cylinder-shaped grinding device.

5. The grinding tool in accordance with claim 1, wherein the cylinder-shaped grinding device primarily grinds by means of a front face thereof.

6. The grinding tool in accordance with claim 1, wherein the strip-shaped grinding devices include flexible grinding device supports, each having grinding devices on at least one of an upper edge and one lateral face.

7. The grinding tool in accordance with claim 1, wherein the strip-shaped grinding devices are arranged in a tab shape along a circumference of the grinding tool.

8. The grinding tool in accordance with claim 1, wherein the inner rotating area has an inner strip, around which a grinding fleece strip, a grinding belt strip or another flexible belt-shaped grinding device are wound.

9. The grinding tool in accordance with claim 8, wherein the inner rotating area has an outer strip, in order to enclose the grinding fleece strip, the grinding belt strip or the other flexible belt-shaped grinding device.

10. The grinding tool in accordance with claim 8, wherein a fastening pin is pushed through at least one of the grinding fleece strip, the grinding belt strip and the other flexible belt-shaped grinding device in order to fix it in place on the grinding tool.

11. The grinding tool in accordance with claim 1, wherein the outer rotating area has radially-oriented depressions for fastening the strip-shaped grinding devices.

12. The grinding tool in accordance with claim 11, wherein the strip-shaped grinding devices are seated in a fan shape in the depressions.

13. The grinding tool in accordance with claim 11, wherein the depressions are aligned at a defined angle in respect to the radial direction.

14. The grinding tool in accordance with claim 1, wherein intermediate layers are used for fastening the strip-shaped grinding devices to the outer rotating area.

15. The grinding tool in accordance with claim 14, wherein the strip-shaped grinding devices and the intermediate layers are clamped in place at the outer rotating area.

16. The grinding tool in accordance with claim 14, wherein the strip-shaped grinding devices are adjustably supported by varying at least one of a thickness, hardness height and shape of the intermediate layers.

17. The grinding tool in accordance with claim 14, wherein the intermediate layers are made of metal or plastic.

18. The grinding tool in accordance with claim 1, wherein the strip-shaped grinding devices are secured to the outer rotating area by at least one of gluing or casting.

19. A material processing machine comprising:

a) a drive motor;

b) a rotating shaft operatively associated with the drive motor; and c) an axially-functioning grinding tool fastened to the rotating shaft, the grinding tool having an inner rotating area and an outer rotating area wherein:

i) the inner rotating area has a cylinder-shaped grinding device having several layers of a grinding device support, the layers are arranged concentrically around a longitudinal axis of the rotating shaft, and ii) the outer rotating area has radially arranged strip-shaped grinding devices.

20. The material processing machine in accordance with claim 19, wherein several axially-functioning grinding tools are arranged offset in relation to each other in order to obtain an increased travel width.

21. A method for processing a workpiece with at least one surface and at least one edge, comprising the steps of:

a) moving a workpiece in a linear direction;

b) cross-grinding at least one surface of the workpiece by means of a multiple-layered cylinder-shaped grinding device arranged concentrically around a rotating shaft; and c) edge grinding along at least one edge of the workpiece by means of strip-shaped grinding devices arranged in a radial direction in respect to the rotating shaft.

22. The method in accordance with claim 21, wherein the cylinder-shaped grinding device grinds with its front face.

23. The method in accordance with claim 21, further comprising the step of applying to the workpiece a water lacquer base following the grinding steps.

* * * * *